US006225539B1

(12) United States Patent
Freeman

(10) Patent No.: US 6,225,539 B1
(45) Date of Patent: May 1, 2001

(54) COMPRESSIBLE PICK FOR STRINGED MUSICAL INSTRUMENTS

(76) Inventor: J. Kirk Freeman, 830 E. 8080 South, Sandy, UT (US) 84094

( * ) Notice: Subject to any disclaimer, the term of this patent is extended or adjusted under 35 U.S.C. 154(b) by 0 days.

(21) Appl. No.: 09/442,811

(22) Filed: Nov. 18, 1999

(51) Int. Cl.[7] ..... G10D 3/16
(52) U.S. Cl. ..... 84/322; 84/320
(58) Field of Search ..... 84/322, 320, 321, 84/315; D17/20

(56) References Cited

U.S. PATENT DOCUMENTS

| | | | | |
|---|---|---|---|---|
| D. 317,171 | | 5/1991 | Saks | D17/20 |
| D. 330,905 | | 11/1992 | Thomas | D17/20 |
| D. 358,833 | | 5/1995 | Ridley et al. | D17/20 |
| 1,184,561 | * | 5/1916 | Napoletano | 84/322 |
| 4,226,160 | | 10/1980 | Picciochi | 84/322 |
| 4,253,372 | | 3/1981 | Filipetti | 84/322 |
| 4,398,444 | | 8/1983 | Walker | 84/322 |
| 4,651,614 | | 3/1987 | Cavallo | 84/322 |
| 4,691,609 | | 9/1987 | Acocella | 84/322 |
| 4,993,302 | * | 2/1991 | Jonathan | 84/322 |
| 5,253,562 | | 10/1993 | Kline | 84/322 |
| 5,341,715 | | 8/1994 | Hucek | 84/322 |
| 5,641,923 | * | 6/1997 | Merski | 84/313 |

FOREIGN PATENT DOCUMENTS

194966 * 3/1923 (GB) .

* cited by examiner

*Primary Examiner*—Shih-Yung Hsich
(74) *Attorney, Agent, or Firm*—Trask Britt

(57) ABSTRACT

A compressible pick for playing a stringed musical instrument. The compressible pick generally includes a compressible body having at least two adjoined striking surfaces on one end and a variable thickness user grip on an opposing end. The compressible body may further include at least one stiffening member to alter the stiffness and acoustic properties of the compressible pick. The compressible pick may also include frictional features that provide an improved grip. Additionally, the compressible pick may include ornamental features.

15 Claims, 7 Drawing Sheets

COMPRESSIBLE PICK FOR STRINGED MUSICAL INSTRUMENTS

TECHNICAL FIELD

The present invention relates generally to the field of musical instruments and, more particularly, to a pick for playing stringed musical instruments, such as a guitar, banjo, ukulele, or the like.

BACKGROUND

Picks, or "plectrums," are commonly used by musicians to play stringed instruments. A conventional pick is generally comprised of a plate-like structure that is usually triangular in shape. The plate-like structure typically includes a gripping region consisting of opposing gripping surfaces, which enables the musician to grasp the pick between his or her thumb and forefinger, and a tip having opposing striking surfaces for impacting the strings of a stringed instrument. Gripping the pick, the musician can repeatedly pluck the strings on an instrument with the striking surfaces in order to produce sound from the instrument.

The design and structure of the conventional pick has been varied widely as changes in geometric features and materials can alter the acoustic properties of the pick, as well as, facilitate use of the pick by a musician. U.S. Pat. No. 4,651,614 to Cavallo; U.S. Pat. No. 4,253,372 to Filipetti; U.S. Pat. No. 4,398,444 to Walker; U.S. Pat. No. 4,226,160 to Picciochi; U.S. Pat. No. 5,253,562 to Kline; U.S. Pat. No. 5,341,715 to Hucek; U.S. Pat. No. 4,691,609 to Acocella; U.S. Pat. No. Des. 330,905; and U.S. Pat. No. Des. 358,833 to Ridley et al., all disclose variations from the conventional pick such as, for example, multiple tips and striking surfaces. However, conventional guitar picks share a common weakness in that they fail to provide adequate structure for enabling the user to grip and control the pick. Thus, a need exists in the field of musical instruments for an improvement over the conventional plate-like pick that provides the musician with positive grip and greater control over motion of the pick.

DISCLOSURE OF THE INVENTION

The present invention provides a compressible pick for playing stringed instruments having features that provide the pick user with an improved grip and greater control over movement of the pick. The invention may provide the musician with multiple striking surfaces and the ability to alter the stiffness and acoustic properties of the compressible pick. Further, gripping and control of the compressible pick may be improved by the additional of one or more frictional features. Also, the compressible pick may include decorative images or other ornamental features.

The compressible pick includes a resiliently compressible pick body having a tip at one end and a variable thickness user grip on the opposing end. The tip has at least two adjoined striking surface and may further include a permanent angle of twist. The pick body may also have frictional features disposed thereon for improved grip and control. Further, the compressible pick may have decorative images disposed on its surfaces. In another embodiment, one or more stiffening members are disposed on the pick body. The stiffening members provide increased stiffniess to the compressible pick and may also alter the acoustical characteristics of the compressible pick.

To use the compressible pick, the musician grasps the variable thickness user grip between a thumb and one other finger. A compressive force is exerted on the variable thickness user grip by the musician's fingers, thereby compressing the variable thickness user grip and pick body. Under compression, internal stresses develop within the pick body and these internal stresses may alter the acoustical characteristics of the compressible pick. Gripping the variable thickness user grip, the musician can strike the string of a stringed instrument with a striking surface. When the musician's fingers release the variable thickness user grip, the compressible pick returns to its original uncompressed state.

In one embodiment, the pick body includes two flexible plates attached to one another adjacent their striking surfaces. Opposite the striking surface of each flexible plate is a gripping surface, both of which combine to form the variable thickness user grip. In a second embodiment, the pick body includes a plurality of flexible members attached to a central spine. Each flexible member has opposing gripping surfaces on one end and opposing striking surfaces on the other end, wherein the opposing gripping surfaces on the flexible members form the variable thickness user grip. In a third embodiment of the invention, the pick body includes a generally planar member having opposing striking surfaces on one end, and a shaped member is attached to the opposing end of the planar member. The shaped member and a portion of the planar member form the variable thickness user grip. In a fourth embodiment, two flexible plates are attached to one another to form the pick body. The pick body has a variable thickness user grip on one end; however, striking surfaces are provided on the opposing end by inserting a conventional pick between the two flexible plates such that a striking surface of the conventional pick extends from the pick body.

BEST MODE OF THE INVENTION

Figure 1:
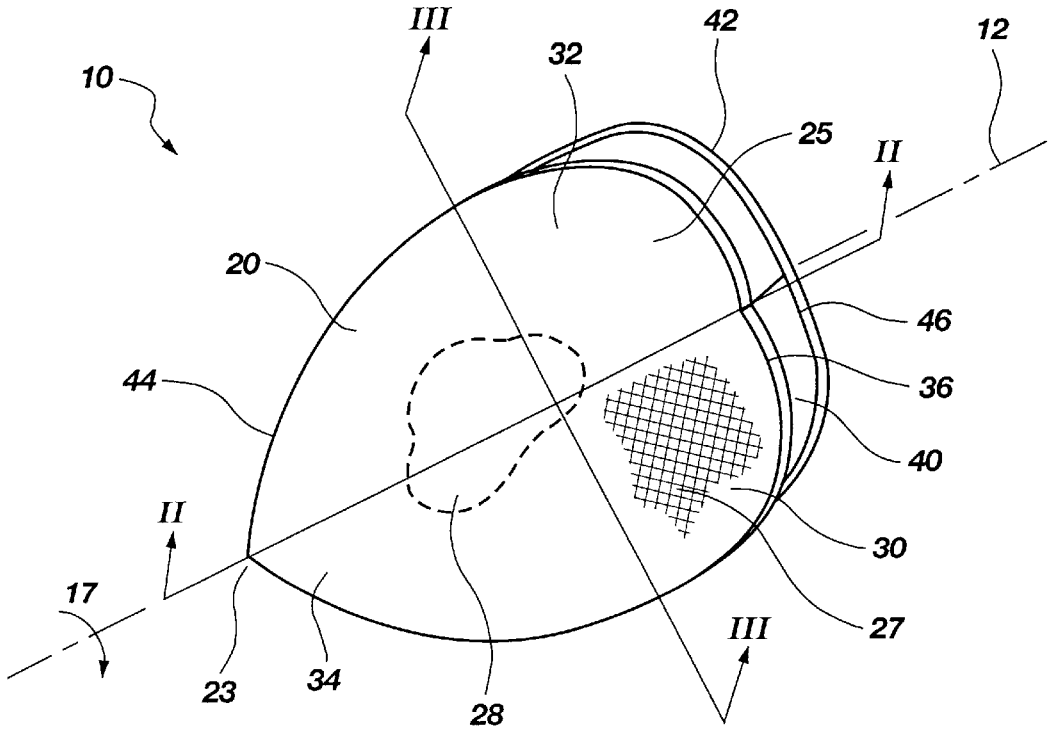
FIG. 1 is a perspective view of a compressible pick according to a first embodiment of the invention.

FIG.'s 1 through 3 depict a first embodiment of a compressible pick according to the invention. The compressible pick 10 generally includes a body 20 that includes first and second resiliently flexible plates 30, 40. The flexible plates 30, 40 have gripping surfaces 32, 42 on one end and striking surfaces 34, 44 on their opposing ends. The flexible plates 30, 40 also have edges 36, 46. Aportion of the edge 36 of the first flexible plate 30 adjacent the striking surface 34 is securely attached to a portion of the edge 46 of the second flexible plate 40 adjacent the striking surface 44. Therefore, the first and second flexible plates 30, 40 combine to form a unitary pick body 20 having a central axis 12, a tip 23 with opposing striking surfaces 34, 44, and a user grip 25 with opposing gripping surfaces 32, 42 opposite the tip.

Figure 3:
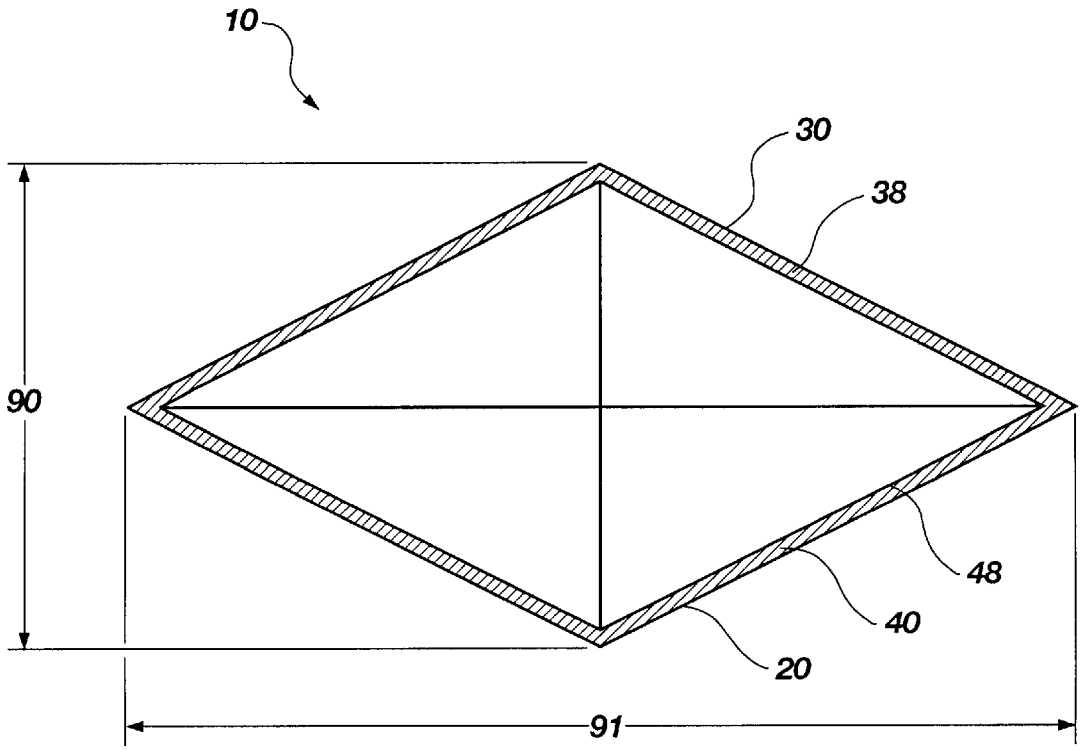
FIG. 3 is a cross-sectional view of the first embodiment of a compressible pick taken along line III—III of FIG. 1.

Referring to FIG. 3, the first flexible plate 30 has a first cross-sectional contour 38 and, similarly, the second flexible plate 40 has a second cross-sectional contour 48. The cross-sectional contours 38,48 shown in FIG. 3 are of a V-shape configuration. At least one of the cross-sectional contours 38, 48 must be non-planar such that the pick body 20 has a plate separation distance 90 that is greater than the combined thickness of the flexible plates 30, 40.

To use the compressible pick 10 shown in FIG.'s 1 through 3, the user grip 25 is grasped between a musician's thumb and one other finger such that the tip of one finger is contacting each gripping surface 32, 42. Because at least one flexible plate 30, 40 is non-planar and the plates 30, 40 are resiliently flexible, finger pressure exerted on the gripping surfaces 32, 42 will compress the pick body 20 such that the overall thickness of the pick body 20 is less than the plate separation distance 90. When the finger pressure is removed from the gripping surfaces 32, 42, the pick body 20 returns to its original uncompressed state. Thus, the compressible nature of the pick body 20 provides for a variable thickness user grip 25.

The compressible properties of the pick body 20 provide a number of advantages for the musician. First, the compressibility and variable thickness of the user grip 25 greatly improve the musician's ability to grasp and to control the compressible pick 10. Also, by adjusting the finger pressure on the gripping surfaces 32, 42, the musician can alter the internal stresses within the flexible plates 30, 40. As the internal stresses of the flexible plates 30, 40 are varied, the acoustic properties of the pick body 20 can be altered. Furthermore, the construction of the compressible pick 10 is easily adapted to provide for additional advantageous features including a pick body 20 having increased variability in stiffniess and acoustic properties through the addition of a stiffening member; a pick body 20 having two flexible plates 30, 40, each plate being constructed of a unique material having different material properties and acoustical characteristics; a wide variety of pick body configurations through variation in the shape of the flexible plates 30, 40, the cross-sectional contours 38, 48, and the taper of the pick body tip 23; a user grip 25 having surfaces 32, 42 with increased frictional properties for improved gripping; and a pick body 20 with ornamental or decorative images thereon. These and other features of the compressible pick 10 are discussed herein.

Figure 2:
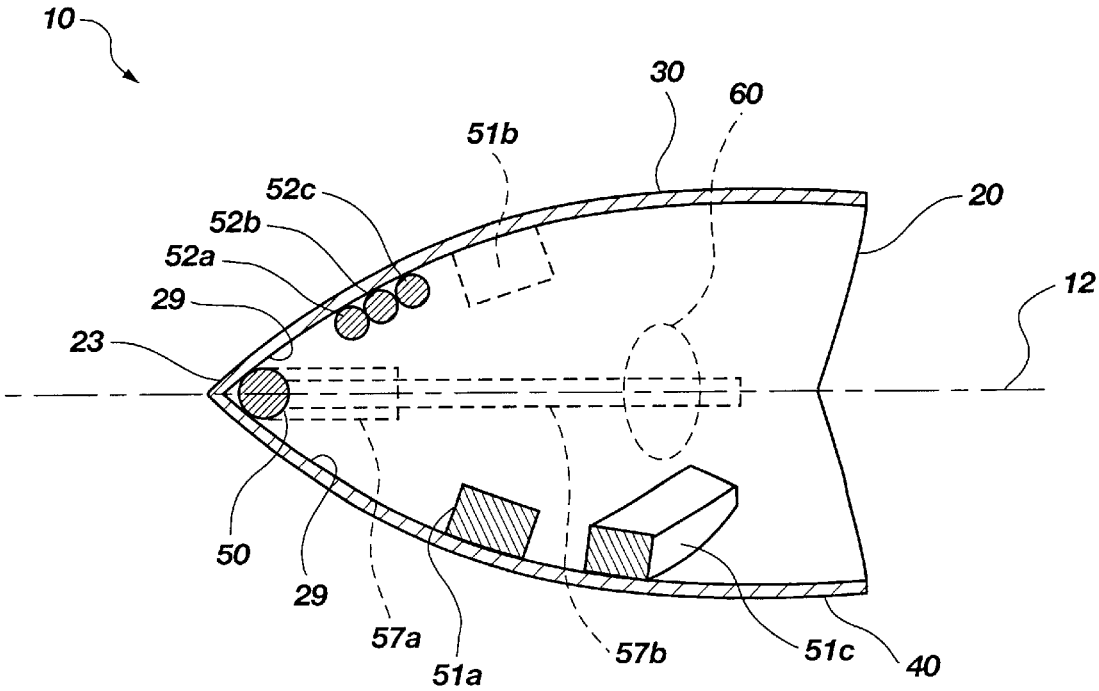
FIG. 2 is a cross-sectional view of the first embodiment of a compressible pick taken along line II—II of FIG. 1.

A compressible pick 10 with a pick body 20 having variable stiffness, as well as variable acoustic properties, may be achieved by the introduction of a stiffening member into the pick body 20. Referring to FIG. 2, a stiffening member 50 is disposed between the first and second flexible plates 30, 40. The stiffening member 50 is a generally spherical-shaped body and is disposed near the tip 23 of the pick body 20. The stiffening member 50 may be either a rigid or a resilient body. If the stiffening member 50 is a rigid body, the rigid body acts as a break when the pick body 20 is compressed, as the rigid stiffening member 50 essentially shortens the effective lengths of the flexible plates 30, 40. Therefore, by altering the effective lengths of the flexible plates 30, 40 through placement of the rigid stiffening member 50, the stiffness of the pick body 20 can be varied. By placing the rigid stiffening member 50 further away from the tip 23 of the pick body 20, the effective lengths of the flexible plates 30, 40 are decreased and the stiffness of the pick body 20 increases. Alternatively, if the stiffening member 50 is a resilient body, the stiffness of the pick body 20 may be varied by altering the resilient properties of the resilient body. Also, the characteristics of the pick body 20 may again be affected by placement of the resilient stiffening member 50 within the pick body 20.

The shape and number of stiffening members may also be varied to alter the stiffness and acoustical characteristics of the compressible pick 10. For example, FIG. 2 shows a stiffening member 51*a* having a generally rectangular parallelepiped body that is disposed approximately midway between the ends of the pick body 20. A mating rectangular parallelepiped stiffening member 51*b* (shown in dashed lines) may also be disposed within the pick body 20 such that, when the pick body 20 is under compression, the stiffening members 51*a*, 51*b* contact one another. Alternatively, as shown in FIG. 2, a stiffening member may include multiple bodies such as, for example, multiple spherical bodies 52*a*, 52*b*, 52*c*.

In another embodiment also shown in FIG. 2, a stiffening member may be a rod-shaped, cylindrical body. The stiffening member maybe a truncated, rod-shaped, cylindrical body 57*a* (shown in dashed lines) or, alternatively, the stiffening member may be a rodshaped, cylindrical body 57*b* (also shown in dashed lines) that extends substantially the longitudinal length of the pick body 20. Additionally, a second stiffening member may be attached to the rod-shaped cylindrical body 57*a*, 57*b*. For example, as shown in FIG. 2, another stiffening member 60 (shown in dashed lines) is attached to the rod-shaped, cylindrical body 57*b*. In a further embodiment, the stiffening member 60 may be slidably attached to the rod-shaped, cylindrical body 57*b*. Thus, the position of the stiffening member 60 along the longitudinal length of the rod-shaped, cylindrical body 57*b* may be slidably adjusted. If the stiffening member 60 is located near the tip 23 of the pick body 20, the effective lengths of the flexible plates 30, 40 are relatively long. As the stiffening member 60 is moved away from the tip 23 and towards the opposing end of the pick body 20, the effective lengths of the flexible plates 30, 40 will decrease and the stiffness of the pick body 20 will increase. Thus, slidably attaching the stiffening member 60 to the rod-shaped, cylindrical body 57*b* forms a variable-position stiffening member in which the stiffness of the pick body 20 may be altered by placement of the stiffening member 60 within the pick body 20. The stiffening member 60 may be either a rigid or resilient body of any suitable shape.

Figure 5:
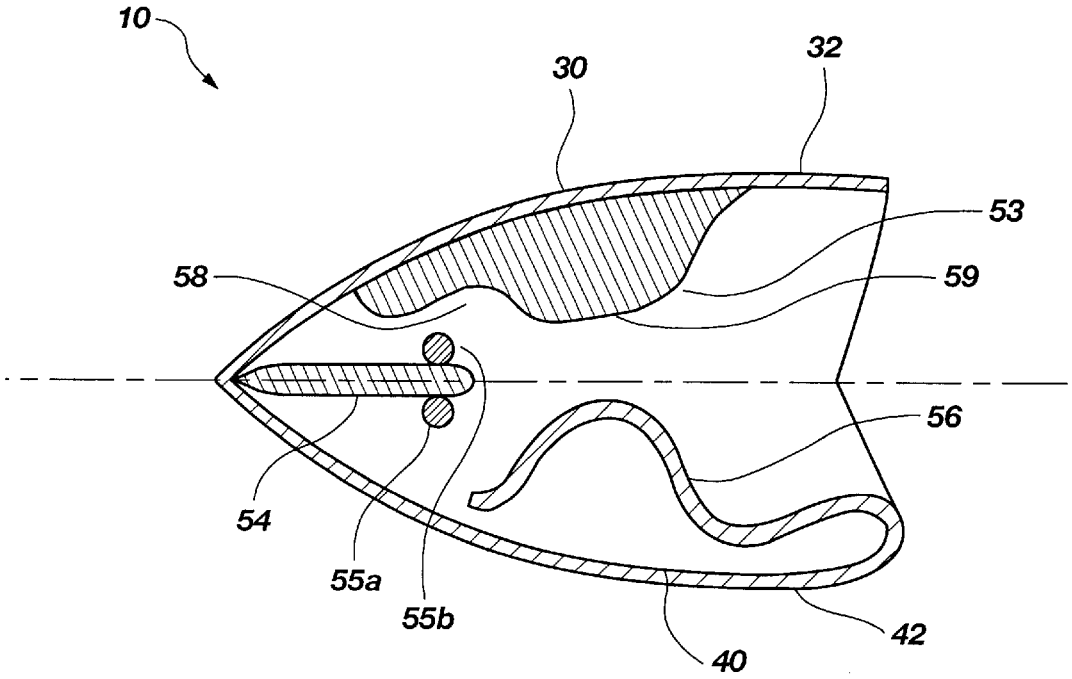
FIG. 5 is a cross-sectional view of the first embodiment of a compressible pick taken along line II—II of FIG. 1.

In a further embodiment, the stiffening member may have a step-contour configuration 53 as shown in FIG. 5. The step-contour 53 allows the pick's user to vary the effective lengths of the flexible plates 30, 40 by placement of the user's fingers on the gripping surfaces 32, 42. Forward finger placement on the gripping surfaces 32, 42 results in utilization of a first riser 58 and rearward finger placement on the gripping surfaces 32,42 results in utilization of a second riser 59 of the step contour 53.

As shown in FIG. 5, a stiffening member may also take the form of a flat plate 54 disposed between the first and second plates 30, 40, respectively. Additionally, other stiffening elements, such as spherical bodies 55*a*, 55*b*, may be securely attached to the flat plate 54. In still another embodiment, a stiffening member is formed from at least one of the flexible plates 30, 40. FIG. 5 shows such a stiffening member 56 that is formed from the flexible plate 40. The stiffening member 56 depicted in FIG. 5 is a cantilevered spring; however, any type of stiffening member could be formed from one of the flexible plates 30, 40. Additionally, both flexible plates 30, 40 may have stiffening members formed thereon.

The number, shape, and location of the stiffening members 51*a*, 51*b*, 52*a*, 52*b*, 52*c*, 53, 54, 55*a*, 55*b*, 56, 57*a*, 57*b*, 60 shown in FIG.'s 2 and 5 is only exemplary and is provided for illustrative purposes. Although FIG.'s 2 and 5 each show a number of stiffening member configurations disposed within the pick body 20, those of ordinary skill in the art will appreciate that any of the stiffening members 50, 51*a*, 51*b*, 52*a*, 52*b*, 52*c*, 53, 54, 55*a*, 55*b*, 56, 57*a*, 57*b*, 60 may be used individually or, alternatively, in combination with any other stiffening members. If multiple stiffening members are used, they may be of substantially identical configuration or of differing configurations. Further, the stiffening members 50, 51*a*, 51*b*, 52*a*, 52*b*, 52*c*, 53, 54, 55*a*, 55*b*, 56, 57*a*, 57*b*, 60 may be disposed at any suitable locations on the pick body 20, depending on the desired characteristics.

It will be appreciated by those of ordinary skill in the art that, in addition to the stiffening members depicted in FIGS. 2 and 5, any other suitable configuration may be used. For example, a stiffening member may simply be a backfill material (not shown in figures), such as foam rubber or other sponge-like polymers, disposed between the first and second flexible plates 30, 40. Further, the configuration of the stiffening members 50, 51*a*, 51*b*, 52*a*, 52*b*, 52*c*, 53, 54, 55*a*, 55*b*, 56, 57*a*, 57*b*, 60 depicted in FIG.'s 2 and 5 may be varied. For example, a rectangular parallelepiped body 51*c* (see FIG. 2) may be eccentrically disposed with respect to the central axis 12 within the pick body 20. Eccentric placement—not perpendicular to the central axis 12—of the stiffening member 51*c* within the pick body 20 provides for the continuous variation of the effective lengths of the flexible plates 30, 40 across the entire width 91 (see FIG. 3) of the flexible plates 30, 40.

Figure 4:
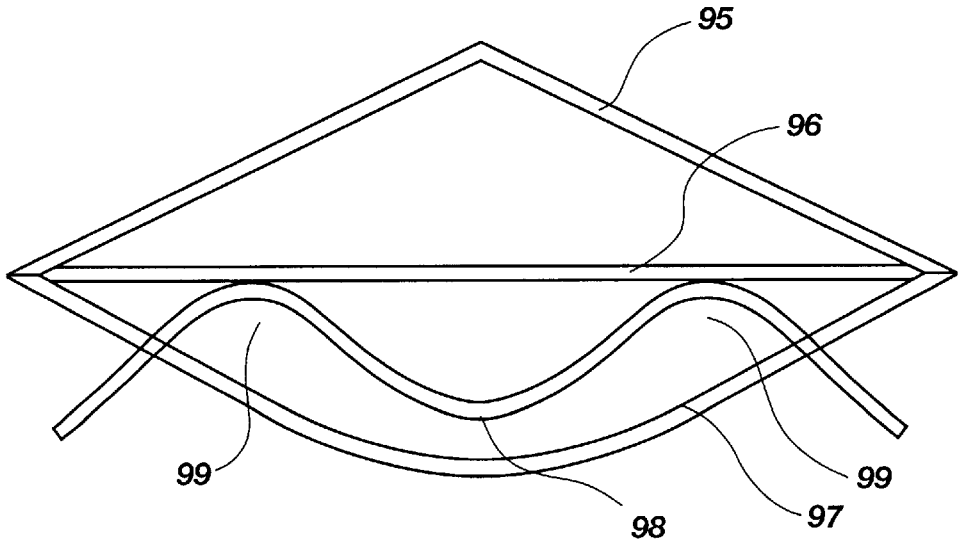
FIG. 4 is a schematic of various cross-sectional contours of the first embodiment of a compressible pick as taken along line III—III of FIG. 1.

As indicated earlier with respect to FIG. 3, the first and second flexible plates 30, 40 have cross-sectional contours 38, 48, respectively. In FIG. 3, the flexible plates 30, 40 each have V-shaped cross-sectional contours 38, 48; however, any suitable cross-sectional contour may be adapted to the present invention. Referring to FIG. 4, the cross-sectional contours 38, 48 may be, by way of example only, V-shaped 95, generally flat 96, generally semi-circular 97, or multi-cusped 98 with at least two cusps 99. Those of ordinary skill in the art will appreciate that the cross-sectional contours 38, 48 may be substantially the same or, alternatively, the cross-sectional contour 38 of the first flexible plate 30 may be different than the cross-sectional contour 48 of the second flexible plate 40. The following examples are illustrative: a generally flat plate 96 may be combined with a V-shaped plate 95, a generally flat plate 96 may be combined with a generally semi-circular plate 97, a V-shaped plate 95 may be combined with a generally semi-circular plate 97, or a multi-cusped plate 98 may be combined with a generally flat plate 96.

Those of ordinary skill in the art will also appreciate that the shapes of the flexible plates 30, 40 defined by their respective edges 36, 46 (see FIG. 1) may be identical and attached to one another in an overlying congruent relationship or, alternatively, attached to one another in an offset relationship. Also, the shape of the first flexible plate 30 defined by its edge 36 need not be the same as the shape of the second flexible plate 40 defined by its edge 46. Further, although the first and second flexible plates 30, 40 as shown in FIG. 2 have generally concave lengthwise tapers 29 near the tip 23, those of ordinary skill in the art will appreciate that the first and second flexible plates 30, 40 may have generally convex lengthwise tapers near the tip 23.

In another embodiment, a permanent angle of twist may be imparted to the pick body 20 near the tip 23. In this embodiment, a portion of the first and second flexible plates 30, 40 near the tip 23 are permanently bent through an angle 17 (see FIG. 1) about the central axis 12. Imparting an angle of twist 17 at the tip 23 alters the angle at which the striking surfaces 34, 44 of the pick 10 approach the strings of a musical instrument.

Referring again to FIG. 1, the gripping surfaces 32, 42 may have increased frictional features 27 added thereto to improve the gripping properties of the compressible pick 10. For example, the gripping surfaces 32, 42 of the flexible plates 30, 40 may be knurled. The knurling may be added using a stamping, molding, or machining process, or any other suitable process as is known in the pertinent art. Alternatively, the frictional features 27 of the gripping surfaces 32, 42 may be provided by a coating, or adhesive-backed substrate, of frictional material. Additionally, decorative images 28 or other ornamental features may be added to the outside surfaces of the flexible plates 30, 40. For example, decorative images 28 may be etched, stamped, or painted onto the flexible plates 30, 40 or, alternatively, decals may be added to the flexible plates 30, 40. Those of ordinary skill in the art will appreciate that decorative images 28 may be formed on the exterior surfaces of the flexible plates 30, 40 or, if the flexible plates 30, 40 are fabricated from a material that is at least partially transparent, decorative images 28 may be formed on the interior surfaces of the flexible plates 30, 40.

Figure 6:
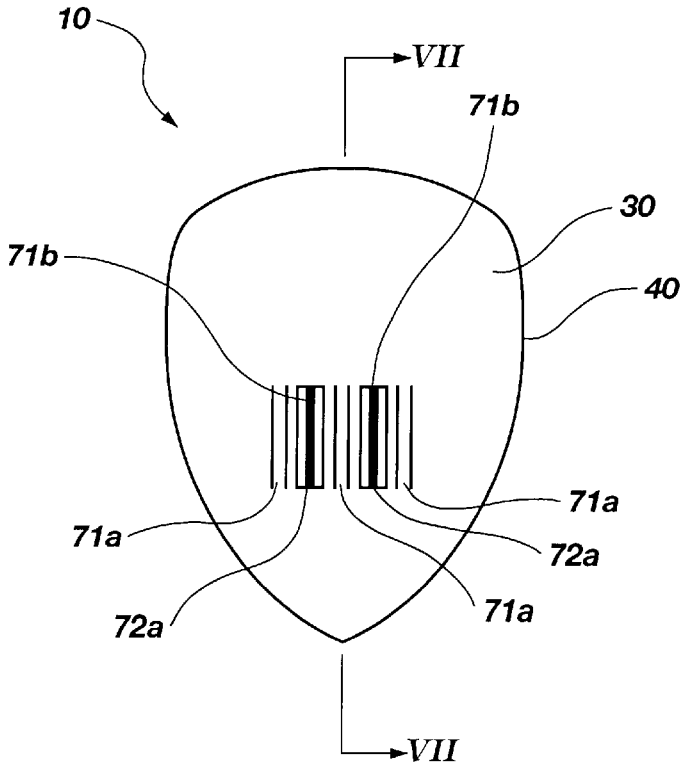
FIG. 6 is a top view of the first embodiment of a compressible pick.
Figure 7:
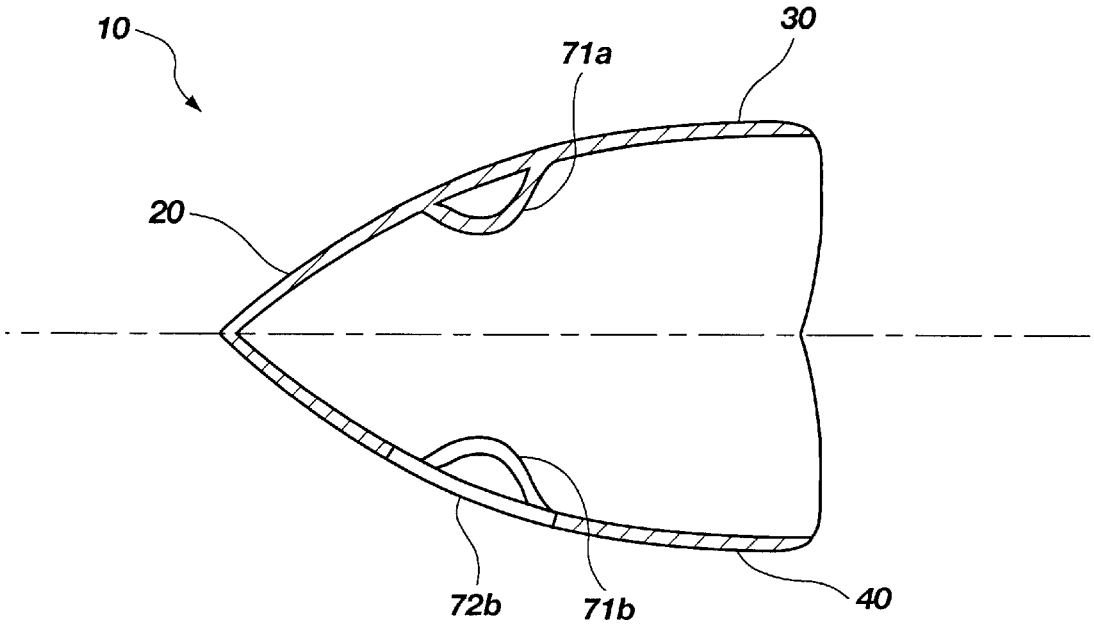
FIG. 7 is a cross-sectional view of the first embodiment of a compressible pick taken along line VII—VII of FIG. 6.
Figure 8:
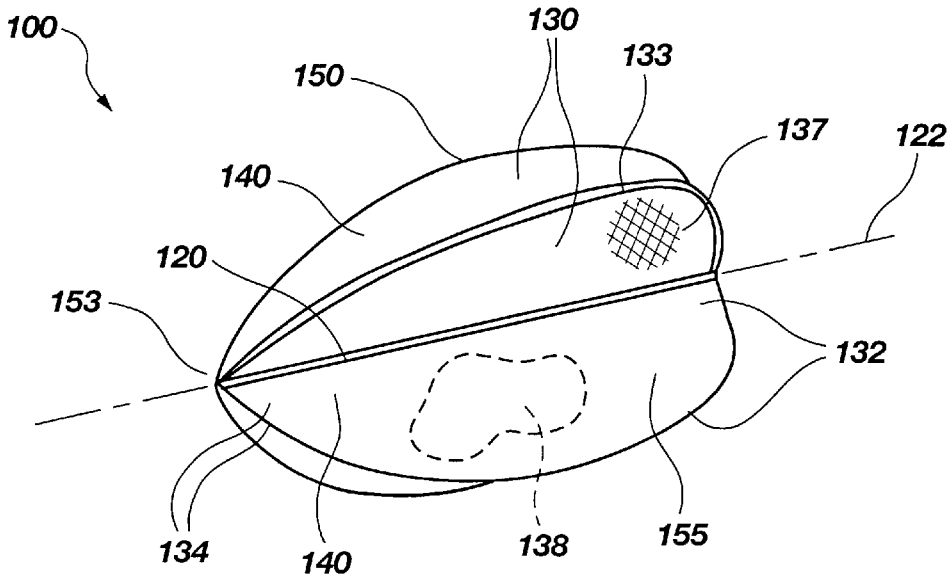
FIG. 8 is a perspective view of a compressible pick according to a second embodiment of the invention.

FIG.'s 6 and 7 show a further embodiment in which the compressible body 20 has a plurality of mating, alternating slots and lands. Referring to FIG. 6, the upper flexible plate 30 has a plurality of lands 71*a* and, alternating between adjacent lands 71*a*, a plurality of slots 72*a*. Similarly, the lower flexible plate 40 also has a plurality of alternating slots and lands; however, the slots and lands on the lower flexible plate 40 are configured opposite the slots 72*a* and lands 71*a* on the upper flexible plate 30. As shown in FIG.'s 6 and 7, the lower flexible plate 40 has a plurality of lands 71*b* that mate with the slots 72*a* of the upper flexible plate 30, and the lower flexible plate 40 has a plurality of slots 72*b* that mate with the lands 71*a* on the upper flexible plate 30. Any suitable number and size of mating, alternating slots 72*a*, 72*b* and lands 71*a*, 71*b* may be used.

The present invention also encompasses methods of manufacture. The first and second flexible plates 30, 40 are preferably manufactured from a plastic material; however, any suitable material known in the art may be used. Similarly, the stiffening members 50, 51*a*, 51*b*, 51*c*, 52*a*, 52*b*, 52*c*, 53, 54, 55*a*, 55*b*, 56, 57*a*, 57*b*, 60 may be fabricated from any suitable material known in the art. For example, a rigid stiffening member may be fabricated of a hard plastic or a metal, and a resilient stiffening member may be manufactured from a rubber material, or any spring material, as is known in the pertinent art. Also, the pick body 20 may be formed of a single piece of plastic, such as may be accomplished with an injection molding process. Alternatively, the first and second flexible plates 30, 40 may be manufactured as separate pieces that are later attached to one another using any suitable bonding process. It will also be appreciated by those of ordinary skill in the art that the first and second flexible plates 30, 40 may be constructed of different materials having unique material properties and acoustical characteristics.

The first embodiment of the compressible pick having been herein described, it will be appreciated by those of ordinary skill in the art that many variations on the compressible pick 10 are possible. Flexible plates 30, 40 having various shapes defined by their respective edges 36, 46, and further having various cross-sectional contours 38, 48, may be combined with any suitable type of stiffening member. The flexible plates 30, 40 may have either a convex or concave lengthwise taper near the tip 23. Also, the tip 23 may have a permanent angle of twist. In addition, frictional properties or decorative images may be added to a flexible plate 30, 40. Thus, numerous design variations for a compressible pick 10 according to the first embodiment of this invention are possible.

Shown in FIG.'s 8 and 9 is a second embodiment of a compressible pick according to the invention. The compressible pick 100 shown in FIG.'s 8 and 9 includes a central spine 120 and a plurality of resiliently flexible plates 130. The flexible plates 130 have opposing gripping surfaces 132 and opposing striking surfaces 134. Each flexible plate 130 has an edge 133 that defines the shape of the flexible plate 130. A portion of the edge 133 of each flexible plate 130 is attached to the spine 120 along its longitudinal axis 122 to form a compressible pick body 150 having a tip 153 at one end and a user grip 155 at the other end. The flexible plates 130 are attached to the spine 120 such that, at the tip 153, the striking surfaces 134 come together at a common point. Between adjacent pairs of flexible plates 130, a plurality of plate gaps 140 are formed. Also, each flexible plate 130 is capable of resiliently folding about the longitudinal axis 122 of the spine 120. Although four flexible plates 130 are shown in FIG.'s 8 and 9, any suitable number of plates may be utilized. For example, the pick body 150 may have three, five, or six flexible plates 130.

To use the compressible pick 100, the musician grasps the user grip 155 by placing a thumb and one other finger in opposing plate gaps 140. Finger pressure is then exerted on the flexible plates 130 within the plate gaps 140. Because the flexible plates 130 may resiliently fold about the longitudinal axis 122 of the spine 120, the user grip 155 is resiliently compressed as finger pressure is exerted thereon. The musician can then strike the string of a stringed instrument with the tip 153, which has multiple striking surfaces 134. When finger pressure is removed from the user grip 155, the pick body 150 returns to its original uncompressed state. Thus, the compressibility of the pick body 150 provides for a variable thickness user grip 155.

The compressible pick 100 of the second embodiment may have at least one stiffening member to alter the compressible properties of the pick body 150. The text describing the addition of stiffening members to the first embodiment 10 is equally applicable to the second embodiment 100 and is incorporated by reference.

Figure 9:
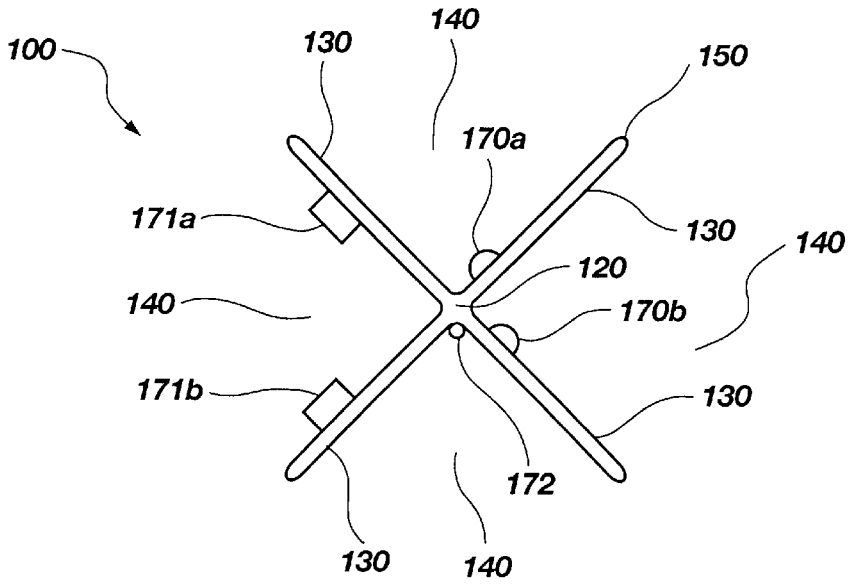
FIG. 9 is a rear view of the second embodiment of a compressible pick.

Referring to FIG. 9, the pick body 150 may include at least one stiffening member such as, for example, the generally spherical shaped stiffening member 170*a* disposed on one of the flexible plates 130. Alternatively, a generally rectangular parallelepiped body 171*a* may be disposed on one of the flexible plates 130. In addition to being attached to a flexible plate 130, a stiffening member may also be attached to the spine 120 such as stiffening member 172. Those of ordinary skill in the art will appreciate that multiple stiffening members may be disposed on the pick body 150, including multiple spherical bodies 170*a*, 170*b* or multiple rectangular parallelepiped bodies 171*a*, 171*b*.

The number, shape, and location of the stiffening members 170*a*, 170*b*, 171*a*, 171*b*, 172 shown in FIG. 9 is only exemplary and is provided for illustrative purposes. It will be appreciated by those of ordinary skill in the art that placement of stiffening members 170*a*, 170*b*, 171*a*, 171*b*, 172 may be varied to alter the effective bending lengths of the flexible plates 130. Additionally, the stiffening members 170*a*, 170*b*, 171*a*, 171*b*, 172 may be formed integral to the pick body 150 or formed as separate parts and attached to the pick body 150. The stiffening members 170*a*, 170*b*, 171*a*, 171*b*, 172 maybe constructed of either a resilient or a rigid material. Any suitable combination of shape, material, placement, and number of stiffening members may be associated with the pick body 150 depending on the desired characteristics.

Figure 10:
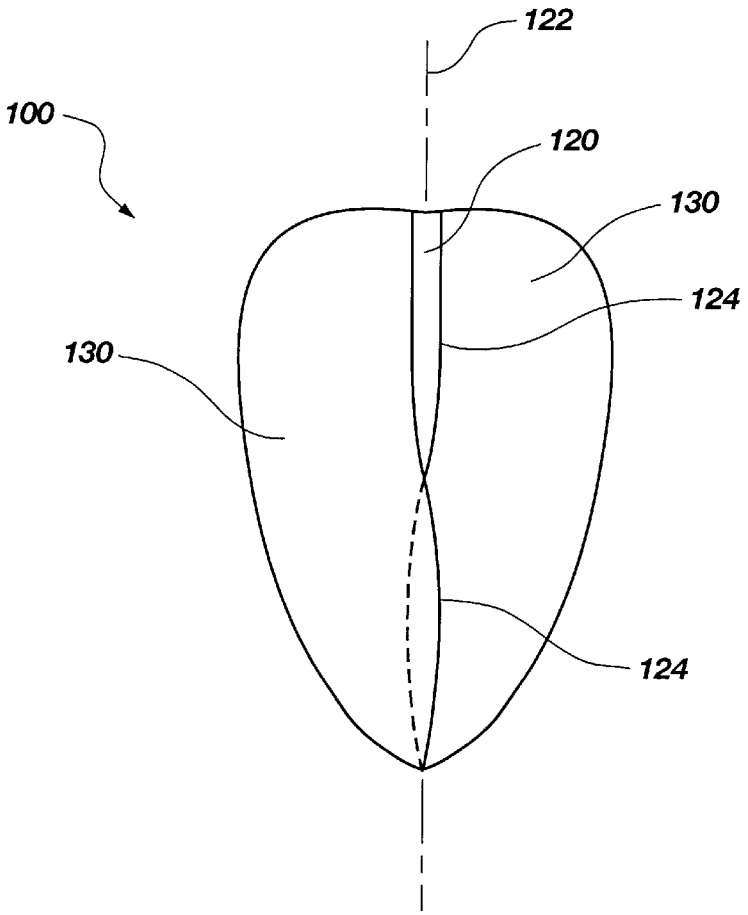
FIG. 10 is an elevation view of the second embodiment of a compressible pick.

Upon compression of the pick body 150 by the exertion of finger pressure at the user grip 155, the flexible plates 130 will normally fold against one another in a congruent relationship (they do not necessarily contact one another). However, the flexible plates 130 may be attached to the spine 120 at different locations along the longitudinal axis 122 of the spine 120. With the flexible plates 130 attached to the spine 120 at different locations, the flexible plates will fold against one another in a non-congruent, offset relationship. Alternatively, the flexible plates 130 may be attached along the longitudinal axis 122 of the spine 120 along a helical path 124 as shown in FIG. 10. When attached to the spine 120 along a helical path 124, the flexible plates 130 will again fold against one another in a non-congruent, offset relationship.

As was shown with respect to the first embodiment 10 of this invention, the compressible pick 100 may also have both frictional features 137 or decorative images 138 added to the surfaces of the flexible plates 130. The frictional features 137 may be provided by either a knurling or a coating process, and decorative images 138 may be added by any suitable process as previously described.

Again, the present invention encompasses methods of manufacture. The flexible plates 130 may all have shapes defined by their respective edges 133 that are identical or, alternatively, one or more plates 130 may have a shape that is different. Also, all of the flexible plates 130 may be constructed of identical material or, alternatively, one or more of the plates 130 may be fabricated from a different material that has material properties and acoustical characteristics distinct from the material used to fabricate the other plates. The flexible plates 130, as well as the spine 120, are preferably manufactured from a plastic material. The flexible plates 130 and spine 120 may be constructed from a single piece of plastic, such as may be accomplished using an injection molding process. Alternatively, the flexible plates 130 and spine 120 may be constructed from separate pieces of material, in which case the spine 120 may be fabricated from any suitable material such as plastic, stainless steel, aluminum, bronze, copper, and brass, which are all believed to be suitable for this purpose. If the flexible plates 130 and spine 120 are fabricated from separate pieces of material, the flexible plates 130 may be either rigidly or removably attached to the spine 120.

The compressible pick body 150 of the second embodiment 100 of this invention shares the advantageous features of the first embodiment 10. The advantages of the compressible pick 100 include improved grip and greater control of the pick 100; variable acoustic properties as internal stresses are induced in the compressible pick body 150; variable stiffness and acoustical characteristics of the pick body 150 through the addition of a stiffening member; a pick body 150 comprised of multiple flexible plates 130, each flexible plate 130 being constructed of a unique material having different material properties and acoustical characteristics; a wide variety of pick body configurations through variation in the shape of flexible plates 130; a user grip 155 having surfaces 132 with increased frictional properties for improved gripping; and a pick body 150 with ornamental or decorative images thereon.

The second embodiment of the compressible pick of this invention having been described, it will again be appreciated by those of ordinary skill in the art that many variations on the compressible pick 100 are possible. Any number of flexible plates 130 having various or identical shapes may be used in combination with any suitable type and number of stiffening members. The flexible plates 130 may be either permanently or removably attached to the spine 120. Also, the flexible plates 130 may be attached to the spine 120 in a helical relationship. In addition, frictional properties or decorative images may be added to the flexible plates 130. Thus, numerous design variations for a compressible pick 100 according to the second embodiment of the invention are possible.

Shown in FIG.'s 11 and 12 is a third embodiment of a compressible pick according to the invention. Referring to FIG.'s 11 and 12, the compressible pick 200 includes a resiliently compressible pick body 210 having a generally planar member 220 and a shaped member 230. The compressible pick body 210 has opposing striking surfaces 224 on the planer member 220, thereby forming a tip 253. On the opposing end of the pick body 210 is a variable thickness user grip 255. The variable thickness user grip 255 has opposing gripping surfaces 222*a*, 222*b* disposed on the planar and shaped members 220, 230, respectively. The pick body 210 also has an edge 226 that defines the shape of the compressible pick 200, which may be of any suitable configuration.

To use the compressible pick 200, the musician grasps the user grip 255 by placing a thumb and one other finger on the opposing gripping surfaces 222*a*, 222*b*. Compressive forces are then exerted against the gripping surfaces 222*a*, 222*b* by the musician's fingers and, because the pick body 210 is resilient, the variable thickness user grip 255 compresses, creating internal stresses within the pick body 210. Gripping the compressible pick 200, the musician can then strike the string of a stringed instrument with the tip 253, which has opposing striking surfaces 224. When the forces exerted on the variable thickness user grip 255 by the musician's fingers are removed, the pick body 210 returns to its original uncompressed state.

The compressible pick 200 of the third embodiment may have at least one stiffening member to alter the stiffness and acoustical characteristics of the pick body 210. The text describing the addition of stiffening members to the first and second embodiments 10, 100, respectively, is equally applicable to the third embodiment 200 and is incorporated by reference.

Figure 12:
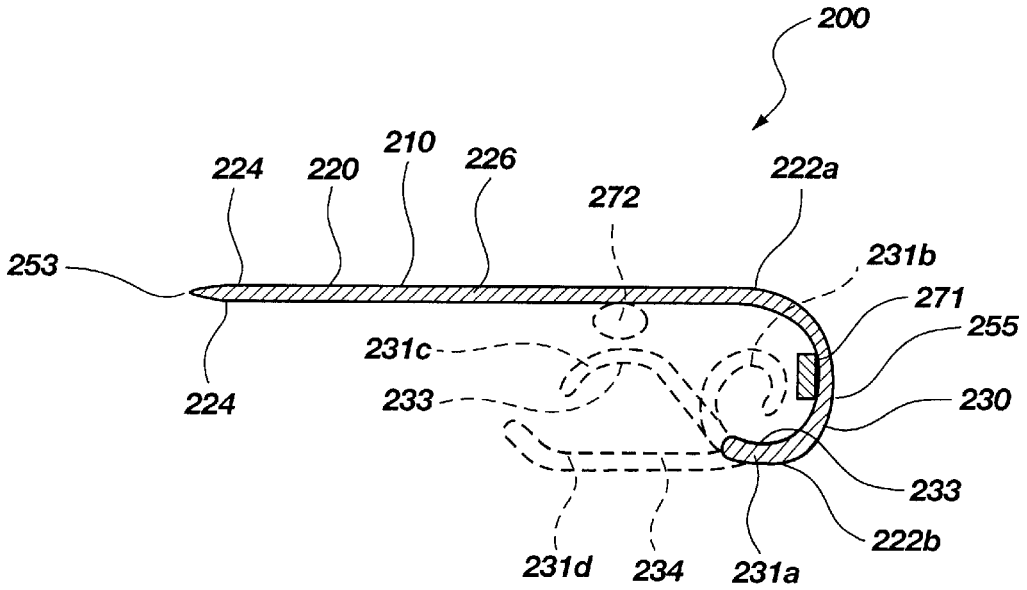
FIG. 12 is a cross-sectional view of the third embodiment of a compressible pick taken along line XII—XII of FIG. 11.

Referring to FIG. 12, the pick body 210 may include at least one stiffening member such as, by way of example only, stiffening member 271. Stiffening member 271 is a rectangular-parallelepiped body attached to the shaped member 230; however, the stiffening member 271 may be of any suitable shape and may be attached to the pick body 210 at any suitable location. For example, a stiffening member may be a generally spherical shaped body 272 (shown in dashed lines) attached to the planar member 220 of the pick body 210. The stiffening members 271, 272 may be constructed of either rigid or resilient material. Further, the stiffening members 271, 272 may be separate pieces attached to the pick body 210 or, alternatively, they may be formed integral to either the planar or shaped members 220, 230 of the pick body 210.

The number, shape, and location of the stiffening members 271, 272 shown in FIG. 12 is only exemplary and is provided for illustrative purposes. Those of ordinary skill in the art will appreciate that the placement of the stiffening members 271, 272 may be varied to alter the stiffness of the pick body 210. Any suitable combination of shape, material, placement, and number of stiffening members may be associated with the pick body 210 depending on the desired characteristics.

Figure 11:
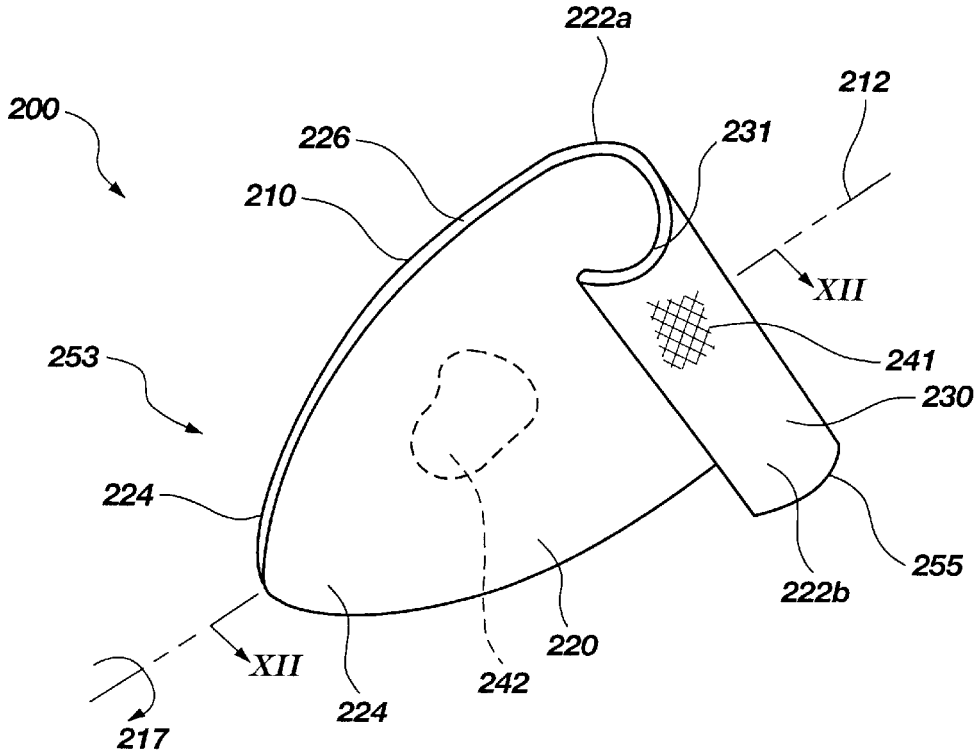
FIG. 11 is a perspective view of a compressible pick according to a third embodiment of the invention.

The shaped member 230 of the pick body 210 has a cross-sectional contour 231 as shown in FIG. 11. The stiffness of the compressible pick body 210, as well as the size and orientation of the gripping surfaces 222*a*, 222*b*, may be varied by altering the configuration of the cross-sectional contour 231. For example, as shown in FIG. 12, the cross-sectional contour 231*a* may have a generally circular shape. Alternatively, the cross-sectional contour 231*b* (shown in dashed lines) may be an extended circular shape that wraps inside itself. In another embodiment, the cross-sectional contour 231*c* (shown in dashed lines) may have multiple cusps 233. In a further embodiment, the cross-sectional contour 231*d* (shown in dashed lines) may have a generally planarportion 234. The cross-sectional contour 231 may be of any other suitable configuration.

In a further embodiment, a permanent angle of twist may be imparted to the pick body 210 near the tip 253. A portion of the planar member 230 near the tip 253 is permanently bent through an angle 217 about a central axis 212. Imparting an angle of twist 217 at the tip 253 alters the angle at which the striking surfaces 224 of the compressible pick 200 approach the strings of a stringed instrument.

As shown in FIG. 11, the compressible pick 200 may also have both frictional features 241 and decorative images 242 added to the surfaces of the pick body 210. The frictional features 241 and decorative images 242 may be disposed on either of, or both, the planar and shaped members 220, 230 of the pick body 210. The previous text describing the addition of frictional features and decorative images to the first and second embodiments 10, 100 is equally applicable to the third embodiment 200 and is incorporated by reference.

The present invention encompasses methods of manufacture. The compressible pick body 210 may be fabricated from any suitable material such as a plastic material. The planar and shaped members 220, 230 of the pick body 210 may be fabricated as a single piece of material, which may be achieved with an injection molding process. Alternatively, the planar and shaped members 220, 230 may be fabricated as separate pieces that are subsequently attached to one another. In a further embodiment, the pick body 210 may be formed as a generally flat plate that, through a secondary shaping process, is formed to have a planar member 220 and a shaped member 230. The stiffening members may be separate pieces of material attached to the pick body 210 or formed integral to the planar or shaped members 220, 230 of the pick body 210.

The compressible pick 200 shares many of the advantageous features of the first and second embodiments 10, 100. The advantages of the compressible pick 200 include improved grip and greater control of the compressible pick 200; variable acoustical characteristics as internal stresses are induced in the pick body 210 under compression; variable stiffness and acoustical characteristics through the addition of one or more stiffening members to the pick body 210; a wide variety of pick body configurations through variations in the cross-sectional contour 231 and the shape defined by the edge 226; a variable thickness user grip 255 having gripping surfaces 222*a*, 222*b* with increased frictional properties for improved gripping; and a pick body 210 having ornamental or decorative images thereon.

The third embodiment of the compressible pick of this invention having been described, it will be appreciated by those of ordinary skill in the art that many variations of the compressible pick 200 are possible. Any combination of shape, cross-sectional contour, stiffening members, frictional features, and decorative images may be incorporated into the pick body 210; thus, numerous design variations for a compressible pick 200 according to the third embodiment of the invention are possible.

Figure 13:
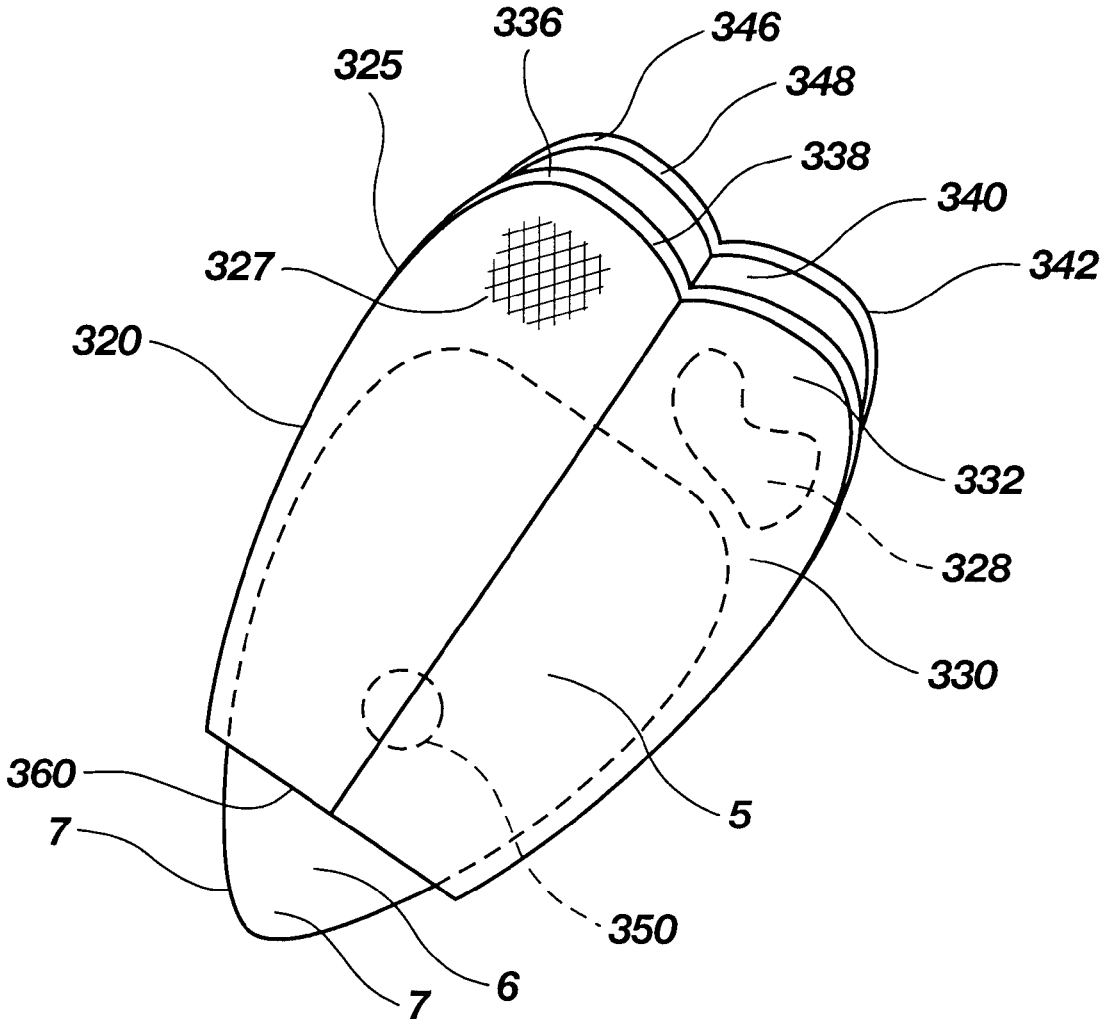
FIG. 13 is a perspective view of a compressible pick according to a fourth embodiment of the invention.

Shown if FIG. 13 is a fourth embodiment of a compressible pick according to the invention. The compressible pick 300 includes a compressible pick body 320 having a first resiliently flexible plate 330 and a second resiliently flexible plate 340. The first flexible plate 330 has an edge 336 that defines its shape and further has a cross-sectional contour 338. Similarly, the second flexible plate has and edge 346 defining its shape and a cross-sectional contour 348. The first and second flexible plates 330, 340 have gripping surfaces 332, 342, respectively, that form a variable thickness user grip 325. Further, the pick body 320 may have one or more stiffening members 350 (shown in hidden lines) attached thereto. Also, the pick body 320 may have frictional features 327 or decorative images 328 disposed thereon. Thus, the compressible pick 300 shown in FIG. 13 is essentially the same as that shown in FIG. 1, and the prior text describing the first embodiment 10 of the invention is incorporated by reference.

The pick body 320, however, does not include a striking surface. Rather, the end 360 of the pick body 320 opposite the user grip 325 has been truncated. A conventional pick 5 has been inserted between the first and second flexible plates 330, 340 such that one end 6 of the conventional pick 5 extends forward of the end 360 of the pick body 320. Opposing striking surfaces 7 are provided by the conventional pick 5.

To use the compressible pick 300, the musician inserts a conventional pick 5 between the first and second flexible plates 330, 340. The musician then grasps the variable thickness user grip 325 between a thumb and one other finger and compresses the pick body 320. Grasping the compressible pick 300, the musician may strike the string of a stringed instrument with a striking surface 7 of the conventional pick 5. When the musician releases finger pressure on the user grip 325, the pick body 320 returns to its original uncompressed state and the conventional pick 5 may be removed from the pick body 320.

The foregoing detailed description and accompanying drawings are only illustrative and not restrictive. They have been provided primarily for clearness of understanding and no unnecessary limitations are to be understood therefrom. Numerous modifications and alternative arrangements may be devised by those skilled in the art without departing from the spirt of the present invention and the scope of the appended claims.

What is claimed is:

1. A compressible pick for playing a stringed instrument comprising:

a compressible body having two flexible members;

a tip on one end of said compressible body, said tip having opposing striking surfaces; and a variable thickness user grip on an opposing end of said compressible body;

wherein said two flexible members are attached to one another proximate said tip.

2. The compressible pick of claim 1 wherein said compressible body comprises:

a first flexible member having a first cross-sectional contour and a first edge forming a perimeter that defines a first shape, said first flexible member further having a striking surface and a gripping surface; and a second flexible member having a second cross-sectional contour and a second edge forming a perimeter that defines a second shape, said second flexible member further having a striking surface and a gripping surface;

wherein a portion of said first edge adjacent said striking surface of said first flexible member is attached to a portion of said second edge adjacent said striking surface of said second flexible member.

3. The compressible pick of claim 2 wherein said first shape and said second shape are substantially the same.

4. The compressible pick of claim 3 wherein said first flexible member and said second flexible member are attached in a substantially congruent relationship.

5. The compressible pick of claim 2 further comprising:

at least one stiffening member disposed between said first flexible member and said second flexible member;

wherein said at least one stiffening member is securely attached to at least one of said first flexible member and said second flexible member.

6. The compressible pick of claim 5 wherein said at least one stiffening member is formed from one of said first flexible member and said second flexible member.

7. The compressible pick of claim 5 wherein said at least one stiffening member is selected from the group consisting of: a spherical shaped body, a generally rectangular parallelepiped body, a rod-shaped cylindrical body, a generally flat plate, a step-contoured body, and a spring.

8. The compressible pick of claim 5 further including a second stiffening member slidably attached to said at least one stiffening member.

9. The compressible pick of claim 5 wherein said at least one stiffening member is a variable-position stiffening member.

10. The compressible pick of claim 2 wherein said first cross-sectional contour is generally planar and said second cross-sectional contour is substantially non-planar.

11. The compressible pick of claim 2 wherein said first cross-sectional contour and said second cross-sectional contour are substantially non-planar.

12. The compressible pick of claim 11 wherein at least one of said first cross-sectional contour and said second cross-sectional contour is selected from the group consisting of: a generally V-shape, a generally semi-circular shape, and a multiple cusp shape having at least two cusps.

13. The compressible pick of claim 11 wherein said first cross-sectional contour and said second cross-sectional contour are substantially the same.

14. The compressible pick of claim 1 further including a permanent angle of twist disposed at said tip of said compressible body.

15. The compressible pick of claim 2 further comprising:

at least one slot disposed on said first flexible member;

at least one land disposed on said second flexible member configured to slidably mate with said at least one slot on said first flexible member;

at least one land disposed on said first flexible member; and at least one slot disposed on said second flexible member configured to slidably mate with said at least one land on said first flexible member.

* * * * *

UNITED STATES PATENT AND TRADEMARK OFFICE

CERTIFICATE OF CORRECTION

PATENT NO. : 6,225,539 B1
DATED : May 1, 2001
INVENTOR(S) : J. Kirk Freeman

It is certified that error appears in the above-identified patent and that said Letters Patent is hereby corrected as shown below:

Column 3,
Line 46, change "stiffniess" to -- stiffness --

Signed and Sealed this

Thirteenth Day of May, 2003

JAMES E. ROGAN
*Director of the United States Patent and Trademark Office*